US007938102B2

(12) United States Patent
Sherry

(10) Patent No.: US 7,938,102 B2
(45) Date of Patent: May 10, 2011

(54) METHOD AND SYSTEM FOR CONSERVING FUEL IN A DIESEL ENGINE

(75) Inventor: William Joseph Sherry, Old Bridge, NJ (US)

(73) Assignee: William Sherry, Old Bridge, NJ (US)

( * ) Notice: Subject to any disclaimer, the term of this patent is extended or adjusted under 35 U.S.C. 154(b) by 0 days.

(21) Appl. No.: 11/937,335

(22) Filed: Nov. 8, 2007

(65) Prior Publication Data

US 2008/0105238 A1 May 8, 2008

Related U.S. Application Data

(60) Provisional application No. 60/864,908, filed on Nov. 8, 2006.

(51) Int. Cl.
*F02M 51/06* (2006.01)

(52) U.S. Cl. ..... 123/476; 123/445

(58) Field of Classification Search ..... 123/445, 123/476, 478, 480, 481, 299, 300, 305; 701/103–105, 112, 114

See application file for complete search history.

(56) References Cited

U.S. PATENT DOCUMENTS 4,058,709 A * 11/1977 Long ..... 701/105
4,069,795 A * 1/1978 Long et al. ..... 123/491
4,284,052 A * 8/1981 Hanisko ..... 123/490
4,502,442 A * 3/1985 Takakuwa et al. ..... 123/406.23
5,033,328 A * 7/1991 Shimanaka ..... 477/109
5,056,360 A * 10/1991 Dosdall et al. ..... 73/114.24
5,099,811 A * 3/1992 Frantz et al. ..... 123/406.62
5,263,453 A * 11/1993 Wakahara et al. ..... 123/436
5,572,975 A * 11/1996 Gillbrand et al. ..... 123/478
6,170,452 B1 * 1/2001 Wisinski ..... 123/179.4
6,474,291 B2 * 11/2002 Collins et al. ..... 123/198 DB
6,840,237 B2 * 1/2005 Strom et al. ..... 123/684
6,895,932 B2 * 5/2005 Meyer ..... 123/406.47
6,948,475 B1 * 9/2005 Wong et al. ..... 123/299
6,959,239 B2 * 10/2005 Williams et al. ..... 701/55
6,978,761 B2 * 12/2005 Meyer ..... 123/406.53
7,027,907 B2 * 4/2006 Le Gall et al. ..... 701/105
7,167,789 B1 * 1/2007 Froloff et al. ..... 701/101
7,219,649 B2 * 5/2007 Duffy et al. ..... 123/299

* cited by examiner

*Primary Examiner* — Mahmoud Gimie
*Assistant Examiner* — Johnny H Hoang
(74) *Attorney, Agent, or Firm* — Patterson & Sheridan, LLP

(57) ABSTRACT

A diesel engine coupled to a transmission and having a fuel injector control system which among other things monitors the load on the engine by measuring the transmission line pressure, a higher pressure being indicative of a greater load. When the pressure is below a preset value and the engine is sufficiently warm, the normal injector firing sequence is altered by not actuating injectors at spaced intervals in the firing sequence. As the pressure and therefore the load decreases, the intervals between which injectors are not actuated are decreased so that in a given number of engine rotations there are fewer injector actuations and as a result of corresponding cylinders being idle, less fuel is supplied to the engine at lighter loads.

11 Claims, 5 Drawing Sheets

NO FIRE EVERY 7TH INJECTOR - 14% FUEL SAVINGS

NO FIRE EVERY 5TH INJECTOR - 20% FUEL SAVINGS

NO FIRE EVERY 3RD INJECTOR - 33% FUEL SAVINGS

□ - cylinder w/fire

▨ - cylinder cold

METHOD AND SYSTEM FOR CONSERVING FUEL IN A DIESEL ENGINE

CROSS REFERENCE TO RELATED APPLICATIONS

This application claims the benefit of U.S. Provisional Patent Application Ser. No. 60/864,908 filed Nov. 8, 2006, the entirety of which is incorporated herein by reference.

FIELD OF THE INVENTION

The present invention relates to the field of diesel engines and in particular to a system and method of improving the fuel economy of a diesel engine.

BACKGROUND OF THE INVENTION

Diesel engines may have different firing orders depending on the make and model of the engine. Firing order in a diesel engine can be described by sequentially naming the injectors in the order they fire, rather than describing the injector by its location on the engine. For example, in an eight injector engine the firing order may be 12345678 even if the injectors are not physically arranged in such order. Firing order may alternatively be designated according to location of the injector being fired. For example, in an engine that has eight injectors, the firing order may be designated 13246587, identifying the first injector as firing first, the third injector as firing second, the second injector as firing third, and so on.

It is known to turn off an injector in a non diesel engine in order to conserve fuel. However, currently, if a diesel engine has a single injector that is not firing the engine will shake. Thus there is a need for an invention that eliminates the shake in a diesel engine when an injector is turned off.

SUMMARY OF THE INVENTION

In one aspect a system is provided that operates to turn off, or not fire, injectors in a diesel engine based on conditions in the engine. In one aspect the firing "outage" is spread equally among all cylinders to eliminate shake. In one embodiment such a system includes a control module programmed to receive information from the engine and based on the information received control the firing of injectors in the engine, specifically, to turn off certain of the injectors based on the information received. As will be apparent to one skilled in the art a control module may simply be the existing device in a vehicle that controls firing of injectors that is specifically programmed in accordance with the present invention. Information that may be used by the control module includes line pressure in the transmission.

In another aspect of the invention a method of controlling the firing of injectors in a diesel engine is provided which includes the steps of detecting conditions in a diesel engine and using means such as logic or programming to instruct a firing sequence in the injectors of the diesel engine. In one embodiment such instructions include turning off at least one such injector. These and other aspects of the invention will be apparent to those skilled in the art.

DETAILED DESCRIPTION

In the following description, for purposes of explanation, specific numbers, materials and configurations are set forth in order to provide a thorough understanding of the invention. It will be apparent, however, to one having ordinary skill in the art that the invention may be practiced without these specific details. In some instances, well-known features may be omitted or simplified so as not to obscure the present invention. Furthermore, reference in the specification to phrases such as "one embodiment" or "an embodiment" means that a particular feature, structure or characteristic described in connection with the embodiment is included in at least one embodiment of the invention. The appearances of phrases such as "in one embodiment" in various places in the specification are not necessarily all referring to the same embodiment.

Figure 1:
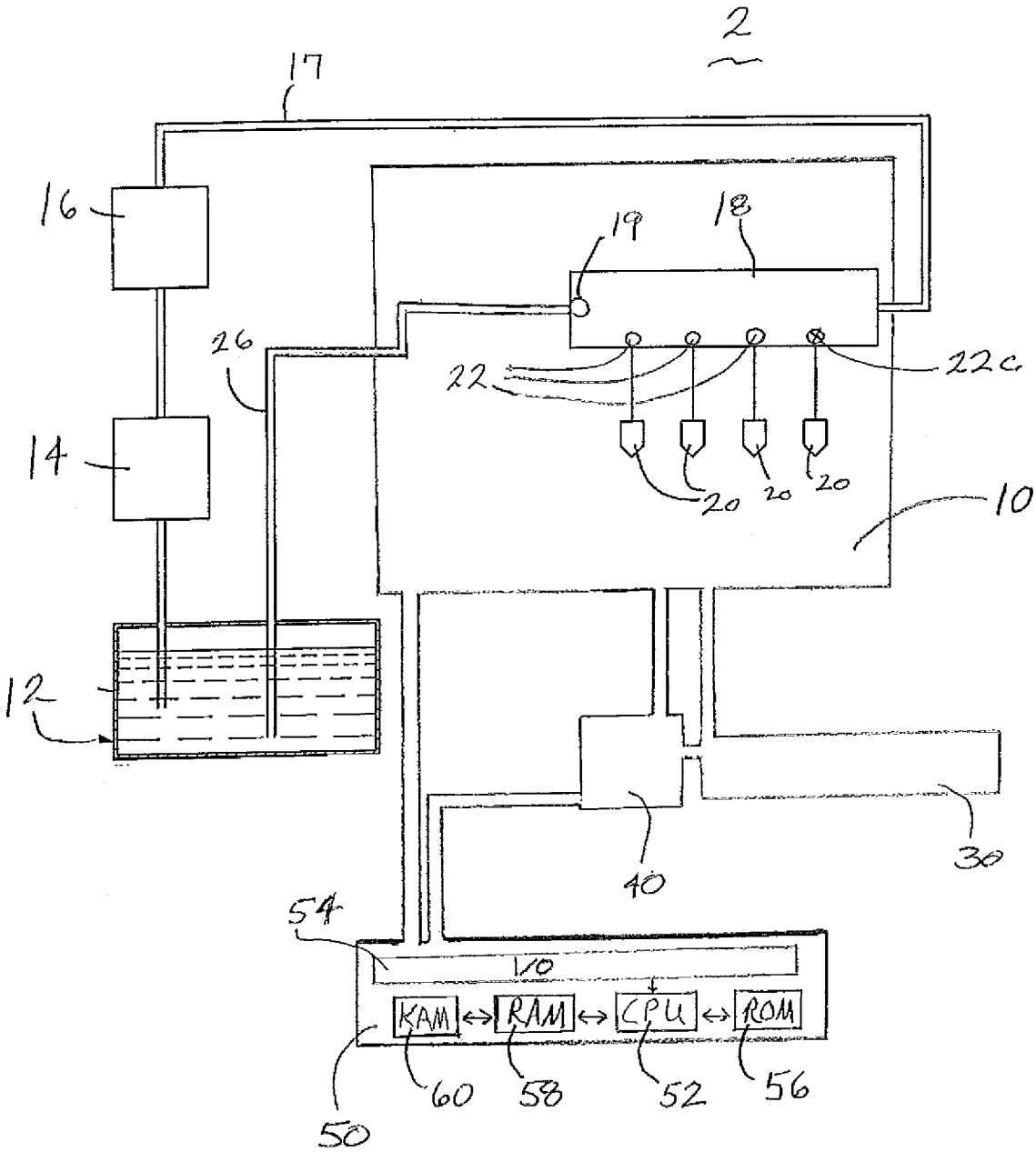
FIG. 1 is a diagram showing portions of a fuel and transmission system of a diesel engine illustrating an embodiment of the invention operable in accordance with at least one aspect of the invention.

In accordance with the present invention, a system is provided that turns off selected injectors at given diesel engine conditions to provide enhanced fuel economy. Now referring to FIG. 1, in one aspect, a system is depicted that operates to turn off, or not fire, injectors in a diesel engine based on conditions in the engine. A system 2 according to the invention includes engine 10, a fuel system including a fuel tank 12, a fuel pump 14, fuel filter 16, fuel line 17 and a fuel rail 18 that delivers fuel to injectors 20 for delivering fuel to the engine cylinders or intake ports, transmission 30, sensor(s) 40 and control module 50.

Each injector 20 includes a valve 22 such as but not limited to a solenoid valve, disposed at the inlet of the injector 20. In one embodiment fuel rail 18 includes a bypass outlet 19 which delivers fuel to a fuel return line 26 leading to the fuel tank 12. Each valve 22 is normally open but is closable (see closed valve 22*c*) to cut off fuel flow to a particular injector 20.

Injectors 20 may be any injector known in the art such as but not limited to magnetic injectors.

In one aspect the firing "outage" is spread equally among all cylinders to eliminate shake. In one embodiment such a system includes a control module programmed to receive information from the engine and based on the information received control the firing of injectors in the engine, specifically, to turn off certain of the injectors based on the information received. As will be apparent to one skilled in the art a control module may simply be the existing device in a vehicle that controls firing of injectors that is specifically programmed in accordance with the present invention. Information that may be used by the control module includes line pressure in the transmission.

Control of the firing of the injectors may be by any suitable means. In an automotive engine, an electronic control unit (ECU) or engine control module (ECM) may be used to initiate the setting although a suitable passive system might alternatively be applied, depending upon the engine control system capabilities. If desired, any other suitable control system for varying firing of the injectors may be utilized. Such alternatives would include a regulator with a variable control actuated by any suitable electronic or pressure responsive means.

A control signal may be a pulse width modulated signal to engage, partially engage, and disengage, a valve based on engine, vehicle, and/or transmission operating conditions.

Control module 50 may be a conventional microcomputer, including a microprocessor unit 52, input/output ports 54, an electronic storage medium for executable programs and calibration values shown as read only memory chip 56, in this particular example, random access memory 58, keep alive memory 60 and a conventional data bus. Control module 50 is adapted to receive various signals from sensors 40 coupled to engine 10, including measurement of inducted mass air flow (MAF); engine coolant temperature (ECT); a profile ignition pickup signal (PIP); throttle position (TP); absolute Manifold Pressure Signal (MAP); engine speed signal (RPM); transmission pressure and the like as are well known in the art. The control module may alternatively be a computer such as a laptop that is adapted to be plugged into the diagnostic port of an engine, containing software adapted to monitor and process the signals received from the engine. Alternatively, an after-market product similar to the Juice ECM Module available from Edge Products of Ogden, Utah may be employed as a control module.

In one embodiment, the transmission pressure is measured by a pressure sensor 40 and the sensed pressure is transmitted to an engine control which in turn operates a valve actuator to close a selected valve 22 whenever the transmission line pressure reaches a predetermined level. If desired, the valves 22 could be provided with a pressure-responsive actuator that could utilize pressure in the intake manifold or differential pressures in the intake system to close the valve 22 whenever a desired pressure level is reached.

In operation a solenoid valve actuator may be de-energized during engine starting and normal operation up to a predetermined level such as transmission pressure, engine temperature or the like.

In another embodiment, valve 22 may be a magnetic solenoid valve.

In one embodiment, when the transmission pressure rises to one or more predetermined levels, the valve actuator is energized to close a selected valve 22, cutting off the flow of fuel through injector 20. The resulting increased fuel pressure may be relieved by excess fuel being delivered through the fuel return line 26 to the fuel tank 12. With the changing of the fuel pressure, the control module 50 may adjust a pulse width control for the injectors 20 to maintain the desired engine output as is well known in the art. It is contemplated that increased pressure may be desirable, so that the injectors 20 inject a greater amount of fuel for a pulse width of a similar time period so that, at any specified control pulse width, the amount of fuel injected by each injector is increased and the engine output is thereby increased.

When the transmission pressure is reduced, the valve actuator may be energized, closing valve 22 and stopping fuel flow through the injector 20.

In another aspect of the invention a method of controlling the firing of injectors in a diesel engine is provided which includes the steps of detecting conditions in a diesel engine and using means such as logic or programming to instruct a firing sequence in the injectors of the diesel engine. In one embodiment such instructions include turning off at least one such injector based on line pressure. Methods in accordance with the present invention may be carried out using suitable processing devices known in the art using suitable software and/or programmed in accordance with the following algorithms.

Figure 2:
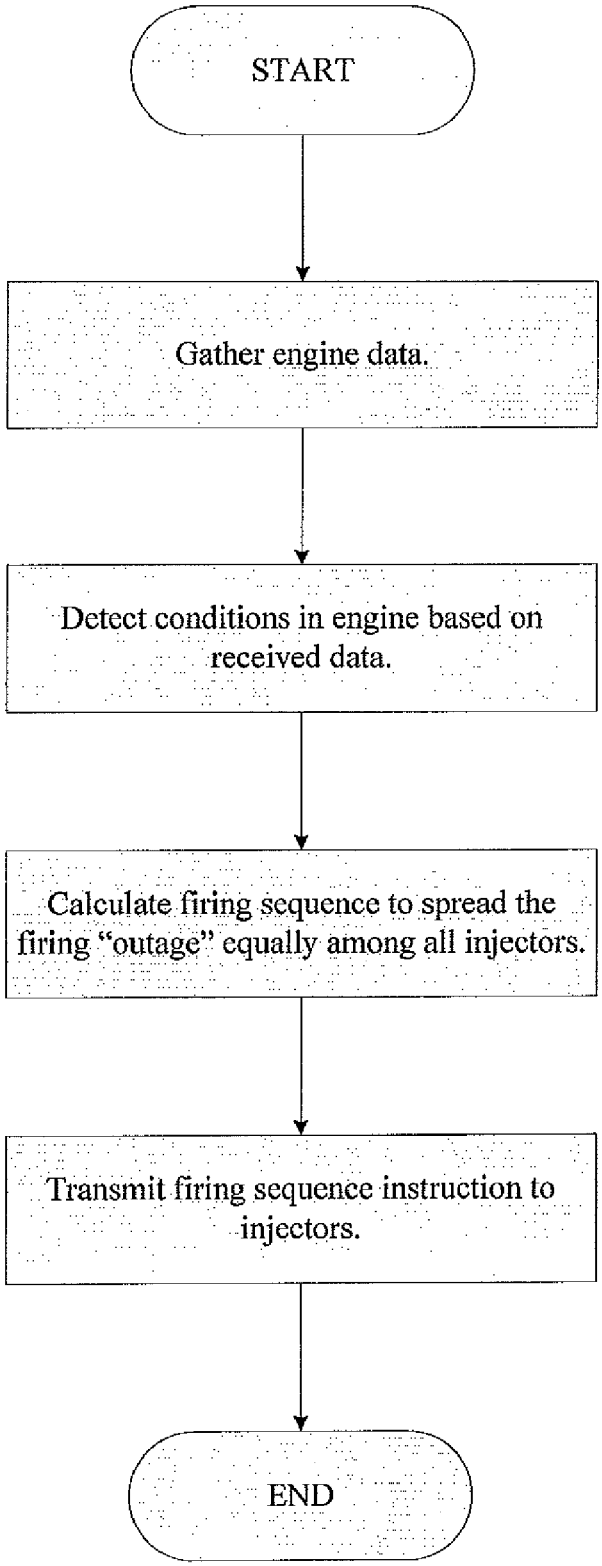
FIG. 2 is a flow chart illustrating a method in accordance with an embodiment of the present invention.

Now referring to FIG. 2, a method of conserving fuel in a diesel engine is described whereby engine data is gathered by the sensor and/or the control module, conditions in the engine are detected based on the data received, the control module calculates the firing sequence to spread the firing outage equally among all injectors and transmits firing sequence instructions to the injectors.

Figure 3:
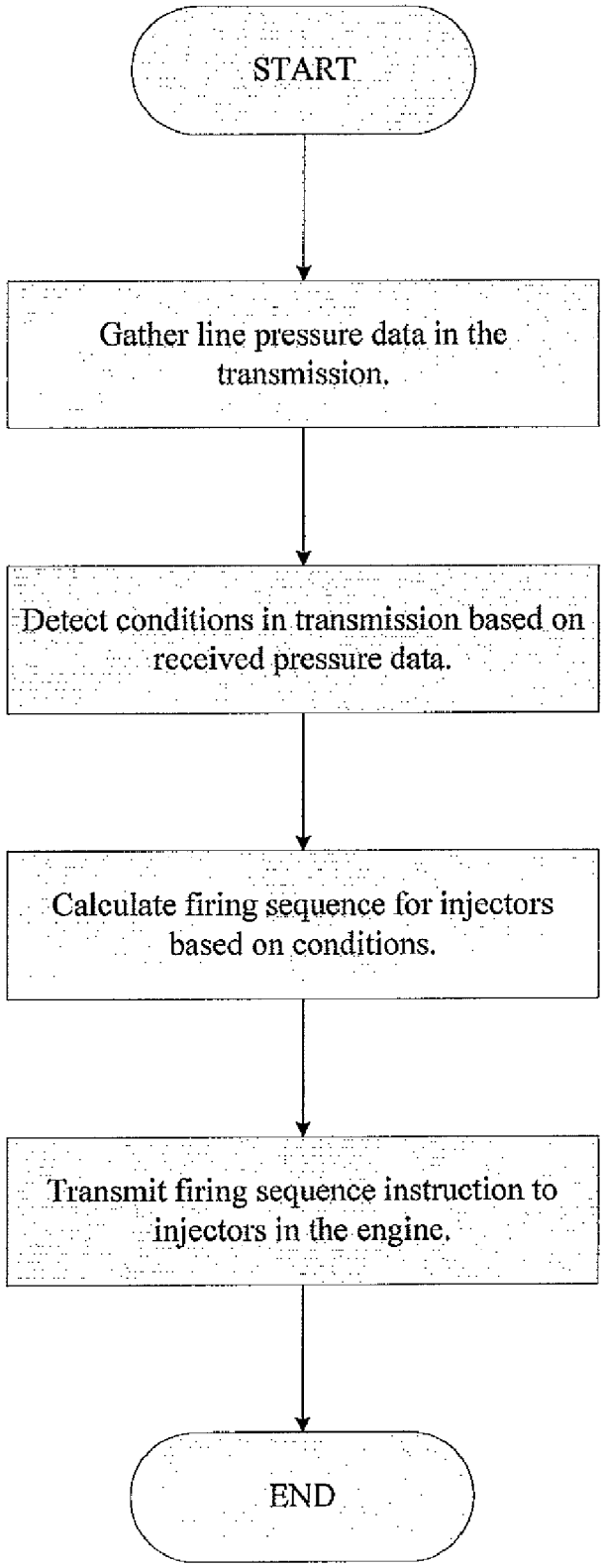
FIG. 3 is a flow chart illustrating a method in accordance with an embodiment of the present invention.

Now referring to FIG. 3, a method of conserving fuel in a diesel engine is described which includes gathering transmission line pressure data, detecting conditions in the transmission based on the received pressure data, calculating a firing sequence for injectors based on the conditions and transmitting firing sequence instructions to the injectors.

Figure 4:
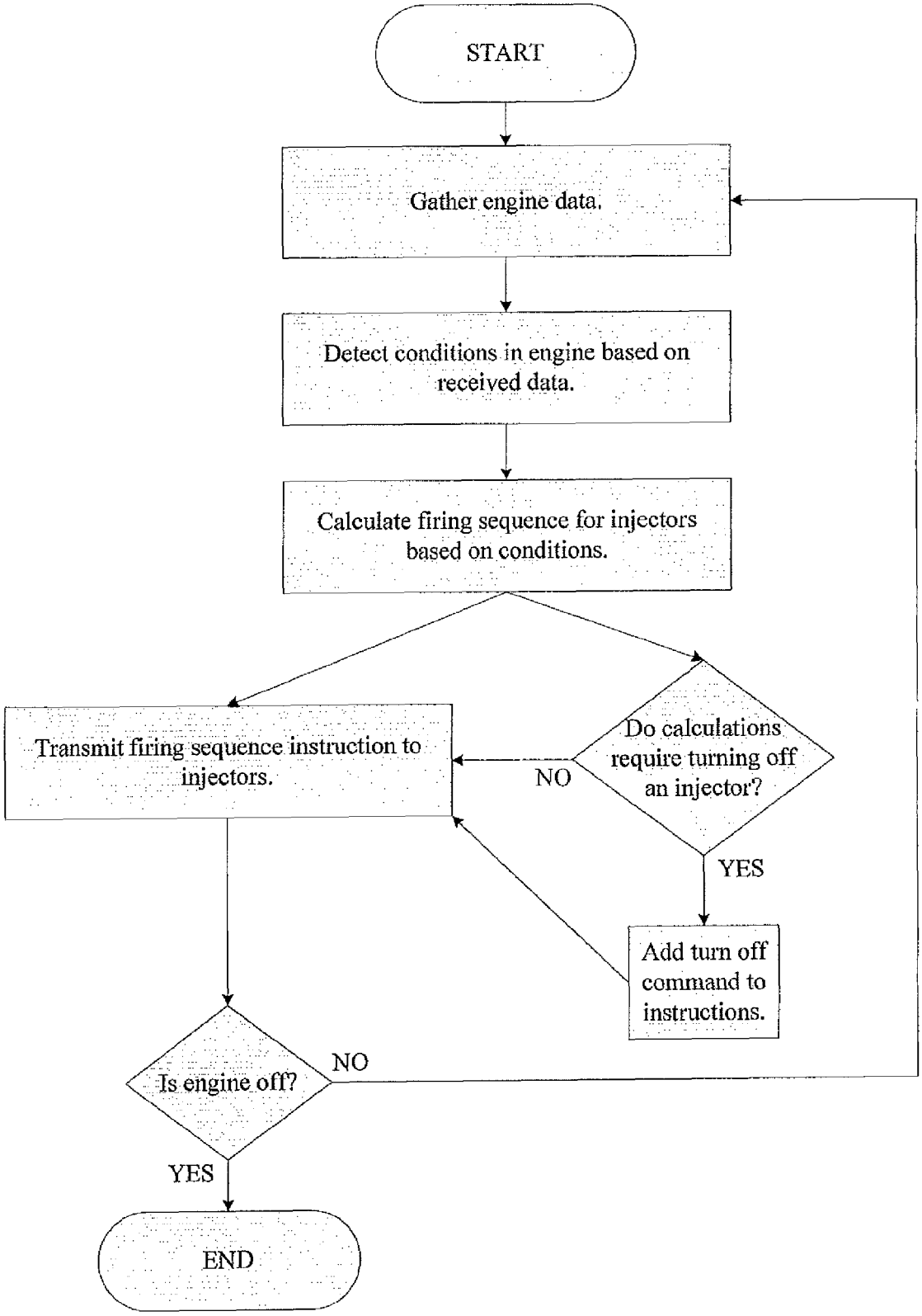
FIG. 4 is a flow chart illustrating a method in accordance with an embodiment of the present invention.

Now referring to FIG. 4, a method of conserving fuel in a diesel engine is described which includes gathering data, detecting conditions in the engine based on received data, calculating the firing sequence for the injectors based on the conditions, determining whether an injector should be turned off and transmitting firing sequence instructions to the injectors.

In one embodiment, the function of shutting off any injector in accordance with the present invention does not begin until the motor is already warm, such as 150 degrees F.

In a preferred embodiment the function of turning off injectors occurs regardless of the gear; the function preferably initiates as a result of the transmission line pressure principally because the transmission line pressure is proportional to load. The greater the load, the greater the pressure.

It will be recognized that the present invention may be employed in any diesel engine regardless of the vehicle or equipment in which the engine is located.

Figure 5:
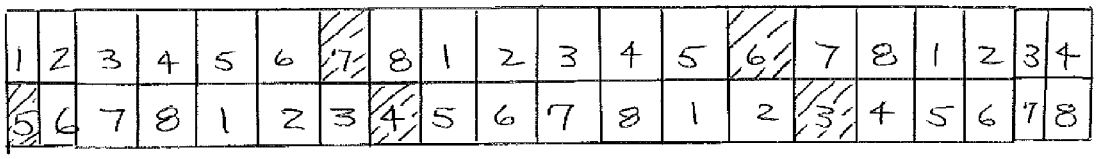
FIG. 5 depicts a table indicating fuel savings based on the nonfiring of given injectors and an example of a firing sequence in accordance with an embodiment of the present invention.
Figure 6:
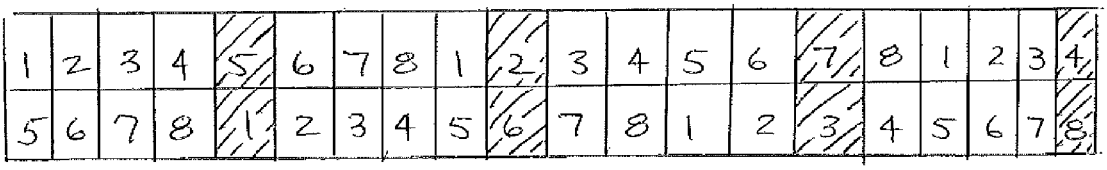
FIG. 6 depicts an example of a firing sequence in accordance with an embodiment of the present invention.
Figure 7:
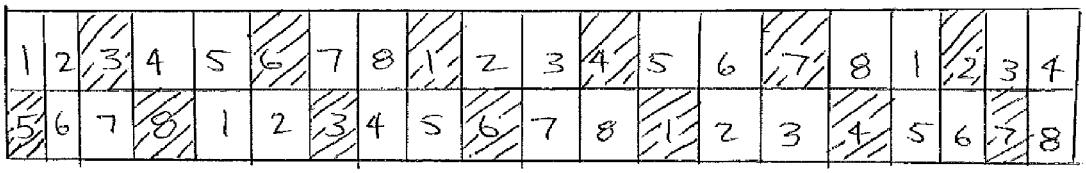
FIG. 7 depicts an example of a firing sequence in accordance with an embodiment of the present invention.

It has been found that turning off certain injectors provides significant fuel efficiency, as shown in the accompanying FIGS. 5-7.

The turning off of the injectors can be varied by the number of cylinders per revolution. For example, if every seventh injector is turned off (see FIG. 5) there will be a fuel savings of approximately 14%. If every fifth injector is turned off, even more fuel is saved (FIG. 6) and if every third injector is turned off even more fuel is saved (FIG. 7). Shutting off every ninth cylinder results in 11% fuel savings; every eleventh results in about 9% fuel savings; every thirteenth results in about 7% savings in fuel and every fifteenth results in about 6% fuel savings.

The turning off of the injectors in accordance with the present invention spreads out the outage and balances the engine firing to eliminate shake.

By way of example and not limitation, the following Table A depicts a scheme that may be programmed into a control module to determine which injectors will not fire under given line pressure conditions:

TABLE A

| | Line Pressure (psi) | | | | | | | |
|---|---|---|---|---|---|---|---|---|
| | 10 | 15 | 20 | 25 | 30 | 35 | 45 | 50 |
| No. of Injector Skipped | — | 3rd | $5^{th}$ | 7th | 9th | 11th | 13th | 15th |

While the preferred embodiments have been described and illustrated it will be understood that changes in details and obvious undisclosed variations might be made without departing from the spirit and principle of the invention and therefore the scope of the invention is not to be construed as limited to the preferred embodiment.

What is claimed is:

1. A method for conserving fuel in a diesel engine having a plurality of fuel injectors fed by a pressurized fuel system, wherein the fuel injectors are normally firing in a pre-determined firing sequence determined by an engine control system, comprising the steps of: monitoring a parameter which is a measure of load on the engine; firing all injectors the same number of times over a given number of engine revolutions while not firing at least one fuel injector normally firing in the pre-determined firing sequence in response to the monitored parameter, during said given number of engine revolutions.

2. The method of claim 1, wherein the parameter is transmission line pressure.

3. The method of claim 1, wherein not firing at least one fuel injector further comprises:

not firing at least one fuel injector only if the engine temperature is above a predetermined value.

4. The method of claim 1, wherein number of injectors not firing in response to the monitored parameter increases as engine load increases.

5. The method of claim 1, wherein not firing at least one fuel injector in response to the monitored parameter further comprises not firing every third fuel injector.

6. The method of claim 1, wherein not firing at least one fuel injector in response to the monitored parameter further comprises not firing every fifth fuel injector.

7. The method of claim 1, wherein not firing at least one fuel injector in response to the monitored parameter further comprises not firing every seventh fuel injector.

8. The method of claim 1, wherein not firing at least one fuel injector in response to the monitored parameter further comprises:

not firing each fuel injector equally.

9. A method for conserving fuel in a diesel engine having a plurality of fuel injectors fed by a pressurized fuel system, wherein the fuel injectors are normally firing in a pre-determined firing sequence determined by an engine control system, comprising the steps of: monitoring transmission line pressure of the engine; firing all injectors the same number of times over a given number of engine revolutions while firing every at least every Nm fuel injector normally firing in the predetermined firing sequence in response to the monitored transmission line pressure during said given number of engine revolution, wherein the number of fuel injectors not firing in response to the monitored transmission line pressure increases as engine load increases.

10. The method of claim 9 further comprising:

only not firing the at least every $N^{th}$ fuel injector if the engine temperature is above a predetermined value.

11. The method of claim 9, wherein the $N^{th}$ fuel injector is selected from the group consisting of a third fuel injector, a fifth fuel injector, a seventh fuel injector, a ninth fuel injector, an eleventh fuel injector, a thirteenth fuel injector, and a fifteenth fuel injector.

* * * * *